United States Patent [19]

Cook

[11] Patent Number: 4,979,833

[45] Date of Patent: Dec. 25, 1990

[54] MULTIPLE USE BAG

[76] Inventor: Teel M. Cook, 726 Windsor Pkwy., Atlanta, Ga. 30342

[21] Appl. No.: 479,115

[22] Filed: Feb. 13, 1990

[51] Int. Cl.[5] ..... B65D 30/06; B65D 33/06; B65D 33/30

[52] U.S. Cl. ..... 383/12; 383/33; 383/74; 383/75; 383/109; 383/117

[58] Field of Search ..... 383/12, 33, 74, 75, 383/76, 109, 111, 117

[56] References Cited

U.S. PATENT DOCUMENTS

| | | | |
|---|---|---|---|
| D. 254,221 | 2/1980 | Beekenkamp | D3/73 |
| D. 296,045 | 6/1988 | Holem | D3/73 |
| 735,560 | 8/1903 | Müller | 383/117 X |
| 1,564,930 | 12/1925 | Boyes | 383/75 X |
| 2,043,782 | 6/1936 | Sprosty | 383/111 X |
| 2,598,334 | 5/1952 | Ahlburg | 383/74 |
| 2,654,892 | 10/1953 | Szabo | 383/33 X |
| 2,815,785 | 12/1957 | Vail | 383/75 X |
| 3,653,583 | 4/1972 | Meyer | 229/54 C |
| 3,826,296 | 7/1974 | Morris | 383/111 X |
| 4,004,722 | 1/1977 | Olivier | 224/45 P |
| 4,148,347 | 4/1979 | Seaman | 150/1.7 |
| 4,174,416 | 11/1979 | Mercer | 428/107 |
| 4,445,230 | 4/1984 | Spadaro | 383/7 |
| 4,691,369 | 9/1987 | Costa | 383/17 |
| 4,694,503 | 9/1987 | Hydorn | 383/12 |
| 4,710,967 | 12/1987 | Petschner | 383/8 |
| 4,739,880 | 4/1988 | Sawyer et al. | 206/223 |
| 4,795,268 | 1/1989 | Jordá | 383/117 X |
| 4,846,519 | 7/1989 | Leonard | 294/171 |
| 4,932,790 | 6/1990 | Jordá | 383/74 |

FOREIGN PATENT DOCUMENTS 1115149 4/1956 France ..... 117/

OTHER PUBLICATIONS

Mid-Atlantic Waste Systems; "Bagit"; 1988 Designed by Bob Bunn of the Bag Connection.

Lillian Vernon; "Welcome at Spring" (catalog); 1990 Nylon Mesh Toy Storage Bags, p. 19, Bathtub Bag, p. 20.

Greenpeace; "The Greenpeace Catalog"; 1989, 1990 Rainbow Warrior Drawstring Totebag, p. 2, Greenpeace Shopping Bag, p. 11.

*Primary Examiner*—Stephen Marcus

*Assistant Examiner*—Jes F. Pascua

[57] ABSTRACT

A bag structure having a semirigid drawstring closure which passes through a hollow handle. The semirigid drawstring holds the mouth of the bag open so that articles can be easily deposited. A shoulder strap is attached to the handle. The shoulder strap and handle are provided for carrying as well as suspending the bag. A flexible tubular material partially inverted creates the double wall of the bag and a fold at the bag mouth. The fold contains the drawstring and the handle, and an additional seam is not required to encase the drawstring. The flexible tubular material is preferably a mesh. Mesh provides a strong bottom seam, which is preferably created by lacing a cord through the mesh openings in the four layers of material. Also, the transparency of the mesh enables an optional product tag to be trapped within the double wall of the bag and visible.

20 Claims, 2 Drawing Sheets

MULTIPLE USE BAG

BACKGROUND—FIELD OF INVENTION

This invention pertains to bags, specifically to bags used as shopping or tote bags or open mouth receptacles.

BACKGROUND—DESCRIPTION OF PRIOR ART

Retail stores generally dispense disposable paper or plastic shopping bags. Because these bags are rarely reused, they pose a problem to the environment. They rapidly consume resources in their production, and they add to the excessive waste already overcrowding landfills. Some plastic bags are not biodegradable or photodegradable. Advantages of these bags are that they are inexpensive to produce and do not have to be maintained by the consumer for reuse. Also they function as promotional advertising for the retail store. However, the cost to the environment may outweigh these advantages. A solution is to provide the consumer with a reusable shopping bag.

U.S. Pat. No. 4,148,347 shows a bag which incorporates durable materials and construction and is reusable. The bag accommodates consumer needs by featuring an adjustable shoulder strap, handles and an adjustable girth which permits the pouch to be used in small and large item receiving capacities. As a reusable bag, it overcomes the disadvantages of the disposable shopping bag. However the complexity of its construction and the materials employed may lead to a higher manufacturing cost and added difficulty in maintenance. Another disadvantage to such bags is the use of "string-like" handles. Although a shoulder strap is provided, the user may choose to carry the bag by the handles. Because a string-like handle does not sufficiently spread the pressure applied to the hand by the weight of the bag, it is uncomfortable to hold.

U.S. Pat. No. 4,691,369 shows a bag whose soft braided or woven handles are the closed bail type and are designed to replace the less expensive string or cord handled shopping bags. Such bags with such soft braided or woven handles are very popular due to their comfort. They attach to a side-gusseted paper bag, however. Disadvantages of this type of bag are that it is generally considered disposable, and no closure is provided to secure its contents. And although the handle is more comfortable than other bail handles, it can still cause discomfort because it wraps around and compresses the hand from the sides.

U.S. Pat. No. 4,846,519 shows an "elongated tubular body." The tube is slotted so that it can slip over the bail handle of a shopping bag and spread the pressure applied to the hand. A rigid tube with a sufficient diameter is more comfortable than even a soft mesh bail handle because the pressure is applied directly to the palm of the hand and not the sides of the hand. Although such a tube improves upon the use of existing shopping bags, a disadvantage is that it is a separate product that must be carried and manipulated by the user; a "band-aid" to the problem of uncomfortable handles.

Bags designed to perform as receptacles for laundry are also well known. U.S. Pat. No. 4,739,880 shows a bag supported by a removable rigid shell insert, which serves as an open-mouth receptacle. The advantage of such a bag is that the insert facilitates depositing laundry into the bag. A disadvantage is that the rigid shell insert requires additional manipulation and storage. This is an inconvenience to the user. Another disadvantage of such a bag is the omission of a handle or strap for carrying. Such bags also feature a drawstring closure. The advantages of a drawstring are that it consists of few and simple parts, is easy to produce, and provides a satisfactory closure to the mouth of a flexible bag.

U.S. Pat. No. 4,694,503 shows a laundry receptacle bag. The bag features a drawstring combined with a detachable support for the mouth. The support is designed to hang from a doorknob or hook. The advantage of this design is that it functions as an open-mouth laundry receptacle without taking up any floor space. A disadvantage is that the bag must be removed from the rigid support to be closed via the drawstring. Also the storage and manipulation of the rigid frame is an inconvenience. Another disadvantage is that a handgrip or shoulder strap is not provided for carrying the bag when it is removed from the frame.

Drawstring or drawcord bags are well known. They are used in plastic bags as well as fabric bags. Drawstring plastic bags are commonly used as shopping bags, trash bags and disposable laundry bags.

U.S. Pat. No. 3,653,583 shows a plastic bag having a drawcord closure in which the drawcord functions as a handle. A disadvantage of this bag is that a drawcord handle is uncomfortable to use for the same reasons a bail handle is uncomfortable, as discussed previously. Another disadvantage is that three seams are required to construct the bag. As in the fabric drawstring bags, this bag is constructed of a sheet of material; the bags must be seamed on the sides and at the mouth to contain the drawstring. Generally, a seam creates a weakness in the bag wall. Also additional seams can add to the cost of production.

U.S. Pat. No. 4,445,230 shows a bag with tubular plastic material so that side seams are not required. Also the closure, which functions like a drawstring closure to gather the bag mouth, is created by lacing the ties through slots cut in the bag near the mouth. The advantage of this feature is that an additional seam is not required. A disadvantage is that the slots weaken the material.

Bags formed of tubular plastic mesh are also well known. U.S. Pat. No. 4,710,967 shows a bag which is primarily designed to have high load-bearing strength. The bag takes advantage of the tube material; a double wall is created by partially inverting the tube. By vertically slitting through the fold at the mouth of the bag a suspension loop is created. The patent recognizes the advantages of a circular woven polypropylene (PP) or polyethylene (PE) material, stating that sacks made of such fabrics are chemical resistant, insusceptible to water, hygienic, non-decomposable, and have good breathing properties. Tubular plastic mesh is also strong and inexpensive. These features make it a common material for packaging.

An example of mesh of this type can be seen in U.S. Pat. No. 4,174,416. That patent shows mesh which stretches only transversely. An advantage is that bags constructed of this mesh would not elongate when loaded. Other tubular mesh materials stretch longitudinally as well as transversely.

At present, many recyclable materials are added to landfills which are already overcrowded. This is partly due to the fact that collection of these materials relies primarily on the voluntary efforts of the consumer, and it is inconvenient to sort the materials and transport them to the recycling centers. A solution is to provide the consumer with a product that will aid in the collection process. A few products have recently emerged. For example, there are stacking bins which are labeled "glass," "newspaper" and "cans." A disadvantage of these bins is that they are space consuming. Also they are difficult to carry; generally only one or two can be carried at a time.

Another available product is the "Bagit System" presently provided by Mid-Atlantic Waste Systems. The "Bagit System" consists of a large bag with a drawstring closure and a rigid frame which supports and holds two of the bags open. The bags are capable of holding larger quantities than the bins. However they too are space consuming when attached to the frame. They are difficult to carry when full, and share other disadvantages of the drawstring bags previously cited. An additional disadvantage of the "Bagit" bags is that the drawstring may not function as effectively as in other bags. The materials used for the bag and the drawstring may not slide as smoothly against each other as in other bags, and the drawstring ends can bend sharply as they pass through a grommet at the front of the bag, causing them to bind when pulled.

At recycling centers glass is presently separated into "clear", "brown," and "green." In addition to newspaper, glass and aluminum cans, other materials are currently being recycled. Plastic foam is chipped and used for insulation. Some plastic containers are ground and formed into fibers for carpet. And non-aluminum cans are used for scrap metal. It is likely that more materials will be added as industry discovers new uses for the "recyclables." Therefore to recycle most effectively, the consumer would need to be able to sort eight or more materials. The containers used for these materials must be as compact as possible, yet capable of holding a sufficient quantity to justify a trip to the recycling center. They should perform as open-mouth receptacles so that it is convenient to deposit materials. They should be easy to close and carry. And they should be constructed of a material that is strong and easily maintained. It is important to note that most recyclables should be thoroughly rinsed prior to their collection. Therefore a mesh fabric which allows the materials to dry is optimal. If this were not the case, a solid material that would contain any foodstuffs would be preferable.

An additional consideration for a shopping bag or a container that is to be used in a recycling program, is that it serve as a promotional item. If a reusable shopping bag were provided by a retail store, that store would want to have advertising in return for its expense. Likewise, a container provided for a recycling program by a community or a corporate sponsor, should serve as a promotional item for that community or corporation through printed advertising. The advantage is that the consumer would have the use of the container at little or no cost in exchange for advertising the program or the services of the sponsor.

SUMMARY OF THE INVENTION

A bag of the present invention is formed of tubular fabric, preferably mesh, which is inverted upon itself to form a double wall. The inversion, or fold, is located at the top, and contains a drawstring and handle. The bottom is formed by lacing together the ends of the tube in a novel way. The bag features a semirigid drawstring closure formed of a material such as plastic tubing, a hollow handle and a shoulder strap. Bags of the present invention may be entirely and readily assembled by hand from commercially available materials. Even the bottom seam can be hand woven. Therefore the product can be introduced to the market without the additional expense of special machinery. Also the product can be assembled in sheltered workshops by workers with handicaps. Further, it can be sold in kit form for assembly by the end user.

The drawstring passes through a hollow handle at the back of the bag's mouth. The ends of the drawstring exit the fold at the front of the bag mouth through holes in the material. The ends then pass through a drawstring bead or retainer located at the front of the bag outside the fold. The retainer helps to hold the drawstring in place. Thus a seam encasing the drawstring is not necessary. The drawstring is constructed of a material that is semirigid. This material stretches so that the diameter of the cord is reduced when it is pulled. Thus the cord slides easily through the retainer for closing the bag and returns to its original diameter when not pulled to bind within the retainer. The semirigid drawstring in combination with the hollow handle allows the bag to be hung and simultaneously function as an open mouth receptacle without an additional frame or structure. A broad open hook or clip, or two open hooks on either side of the center of the handle may be used to prevent the bag from tilting and sliding to one side. The handle also provides a comfortable handgrip which effectively spreads the pressure applied to the hand by the weight of the contents of the bag.

Through the hollow handle, alongside the drawstring, runs a loop of material which forms a shoulder strap. The shoulder strap can be used to conveniently carry the bag or to hang the bag from a doorknob or hook. Thus the bag, which can be hung by either the shoulder strap or the handle, may serve as an open mouth receptacle without taking up floor space.

The preferred embodiment of the present invention is constructed of a tubular mesh. The tubular mesh can be made to specification. Variables include material, color, tube diameter, mesh size and weight. Therefore it can accommodate a multitude of possible uses for the present invention.

The preferred embodiment of the present invention makes use of the mesh openings in assembly; the shoulder strap and the drawstring ends run through the mesh openings at the folded edge, or mouth of the bag. Thus the material does not need to be perforated. Also a very strong bottom seam is created by lacing a length of cord through the mesh openings in the four layers of material. The seam is inverted (formed inside-out) so that the bag has a neat appearance. A wall mounted rack may aid in organizing groups of bags used for sorting materials such as recyclables or laundry. The rack would have hooks or knobs spaced to accommodate a horizontal or vertical row of the bags. A freestanding support for the bags may also be advantageous. A rack that holds a single bag may be useful in a retail store checkout line, similar to those currently used for disposable plastic bags in grocery stores.

In addition to its applications as a reusable shopping bag and a receptacle for laundry or recyclables, there are many more uses for the present invention. Some examples include a tote bag, diaper bag, bag for sports equipment, or beach bag. As a beach bag, the present invention, when constructed of plastic mesh, enables beach toys to be carried, washed off and hung dry while remaining in the bag. As a tote bag, an advantage of the mesh is that the items can be seen, and retrieving the items as needed is more convenient. As a storage bag for toys, the present invention is safer for children than an ordinary drawstring bag. The drawstring passes through the handle and is incapable of tightly encircling any part of a child's body. And there is less risk of suffocation or cutting off blood circulation. Also, the ends of the drawstring are knotted or flanged, so that the drawstring retainer can not easily be removed by a child. Thus the risk of choking on the retainer is less than in many toys having small parts. Besides its use for transporting materials to recycling centers, the present invention can be employed in the curbside pickup of recyclables. The bags can serve in the home for sorting the materials, and either hung inside curbside sheds or on mailboxes to be emptied by the collectors. If this is found to be impractical, larger curbside containers, possibly a large scale of the present invention, could remain curbside. And the smaller bags, when full, can be emptied into the curbside containers.

Currently citizens groups have become interested in providing citizens with bags specifically designed for promoting recycling. In order to receive corporate backing, such groups need to be able to offer the bag as a promotional item. The "floating tag" enables them to do this. The corporate sponsor may have their logo printed on a tag along with a slogan or the recycle/-reuse symbol. For this application the bag of the present invention may feature a "floating tag." The tag may be a four inch disk that can slide freely between the inner wall and the outer wall of the bag. The tags can also help identify the bags. Most individuals have misgivings about using the same container for holding food as they use for holding recyclables. The materials used and the floating tag can serve to distinguish bags for different functions. For example, a grocery bag could have the name of the store that provided it printed on the tag. It could also have a different color shoulder strap or body from a bag used for recyclables. Laundry bags can come in designer colors and have symbols for "dark," "light" and "medium" printed on the tag.

Although the present invention is pro-environment and is offered as a possible solution to aid in the recycling programs, it is neither biodegradable nor easily recyclable itself. It is important to understand that although plastic is inexpensive to produce, it is a very valuable material as it is created from oil which can not be produced by man. Therefore products constructed of plastic should be designed to be valued and reused. Therefore the present invention has the advantage of being reusable. And it is valuable given its many uses.

It is an object of the present invention to provide a bag which combines advantages of specific bags, in order to function as a multiple use bag and to minimize waste caused by disposable bags.

It is a further object of the present invention to provide the consumer with a product useful for sorting and transporting recyclable materials so that the collection of these materials is more successful.

It is a further object of the present invention to provide a bag which hangs from a hook or doorknob and simultaneously performs as an open mouth receptacle without the aid of a separate rigid support.

It is a further object of the present invention to provide a bag that is easily carried.

It is a further object of the present invention to provide a bag which employs a drawstring closure to secure its contents.

It is still another object of the present invention to provide a bag which may be readily assembled and easily cleaned and maintained.

Other objects, features and advantages of the present invention will become apparent with reference to the remainder of this document.

BRIEF DESCRIPTION OF THE DRAWINGS

The invention is now illustrated in detail by means of the drawings in which.

DESCRIPTION OF THE PREFERRED EMBODIMENT

Figure 1:
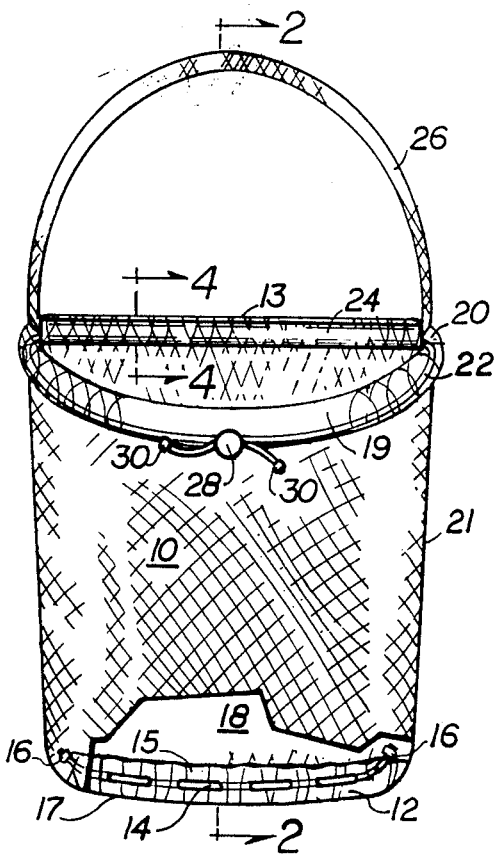
FIG. 1 is a front elevational view of a preferred embodiment of a bag according to the present invention having a cut away section to show elements not otherwise visible.

Referring to the figures, FIG. 1 shows a bag constructed of a flexible tubular material 10, cut away to expose the bottom seam 12 which is constructed of a length of cord 14 woven through the ends 15 of the four layers of the tubular material 10. The cord ends are knotted 16 to hold the cord 14 in place. The seam 12 is inverted so that the ends 15 of the tubular material 10 are in the bag cavity 18.

Figure 2:
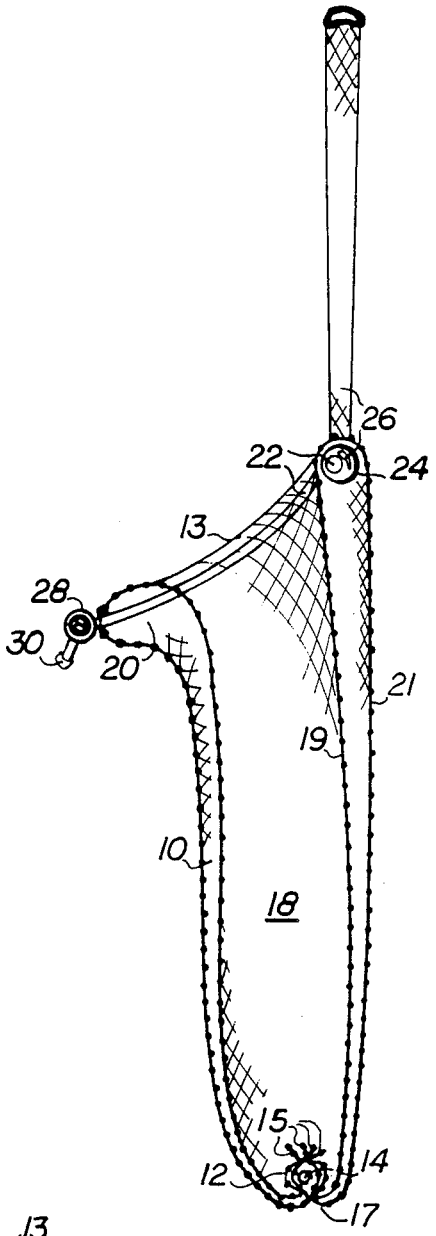
FIG. 2 is a sectional view of the bag of FIG. 1 taken along lines 2—2 of FIG. 1

FIG. 2 shows a sectional view of the bag which has a double wall created by partially inverting the tubular material 10. The fabric tube 10 may be inverted inwardly on itself in the mouth, in the same way that a sock is inverted on itself above the ankle. The fold 20 forms the top 13 of the bag, the ends 15 form the bottom 17 of the bag. The fabric 10 then forms an inner wall 19 and an outer wall 21. Contained within the inversion or fold 20 at the mouth of the bag is a semirigid drawstring 22 which holds the mouth of the bag open. The semirigid drawstring 22 passes through a hollow handle 24 also contained within the fold 20 at the mouth of the bag. A shoulder strap 26 runs alongside the semirigid drawstring 22.

Figure 3:
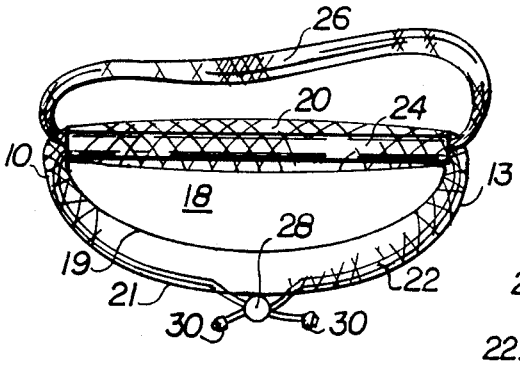
FIG. 3 is a top view of the bag of FIG. 1.

FIG. 3 shows a top view of the bag with the bag mouth held open by the semirigid drawstring 22. The drawstring 22 passes through the flexible tubular material 10 to engage the drawstring retainer 28. The drawstring ends pass through the retainer 28 from either side, crossing within. The drawstring ends are then knotted 30 to hold the retainer 28 in place. The shoulder strap 26 passes through the tubular material 10 at either end of the hollow handle 24.

Figure 4:
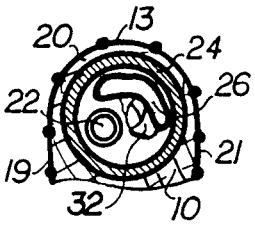
FIG. 4 is a sectional view of a portion of the bag of FIG. 1 taken along lines 4—4 of FIG. 1.

FIG. 4 shows a cross section of the hollow handle 24 contained within the fold 20 of the tubular material 10. The semirigid drawstring 22 passes through the handle 24, as stated. The shoulder strap 26 runs alongside the drawstring 22 and is knotted or otherwise fastened 32 within the handle 24.

Figure 5:
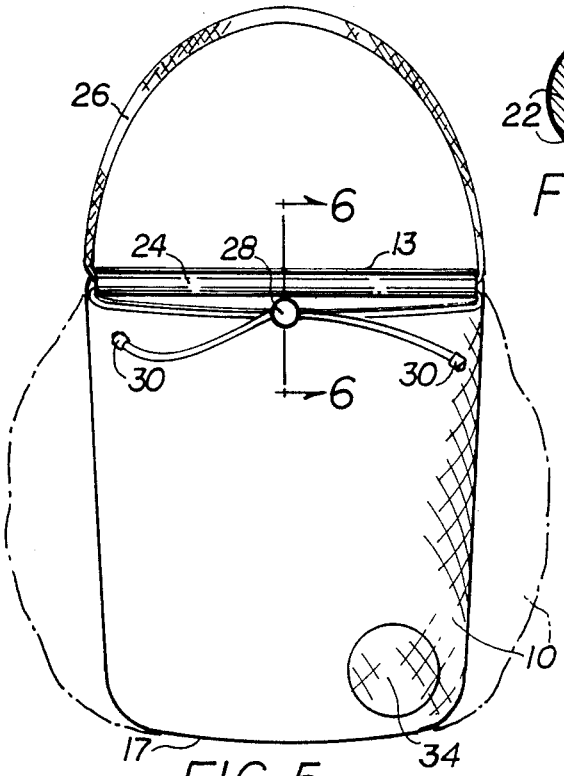
FIG. 5 is a front view of the bag of FIG. 1 drawn closed also showing the bag expanded.

FIG. 5 shows a front view of the closed bag. The knotted ends 30 of the semirigid drawstring 22 are pulled simultaneously through the retainer 28 to draw the bag closed. The flexible tubular material 10 expands to accommodate the bags contents. Also shown is the optional "floating tag" 34, which is trapped between the inner wall 19 and the outer wall 21 of the bag.

Figure 6:
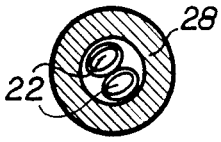
FIG. 6 is a cross section of the bag of FIG. 1 taken along lines 6—6 in FIG. 5.

FIG. 6 shows a cross section of the two end segments of the semirigid drawstring 22 inside the retainer 28. The combined diameters of the two end segments of the drawstring 22 are greater in size than the inside diameter of the retainer 28 and bind to hold the mouth of the bag closed.

Figure 7:
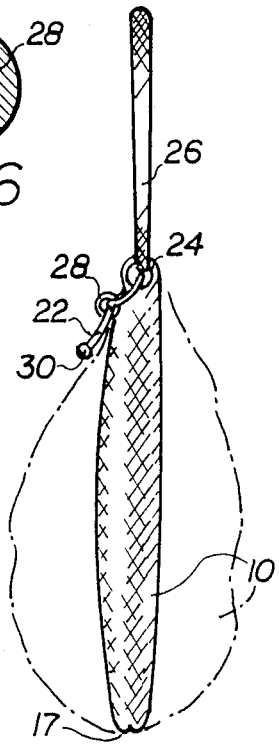
FIG. 7 is a side view of the bag of FIG. 1 drawn closed also showing the bag expanded.

FIG. 7 shows a side view of the closed bag. As in FIG. 5, the flexible tubular material of the bag 10 is shown expanded and nonexpanded.

Figure 8:
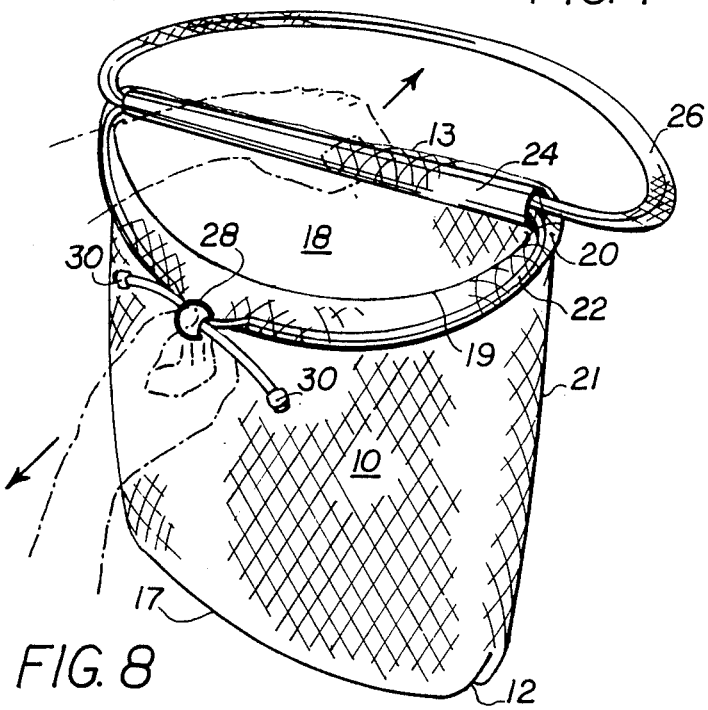
FIG. 8 is a perspective view of the bag of FIG. 1 showing how the bag is opened.

FIG. 8 shows a perspective view of the bag being opened. By pulling the handle 24 and the drawstring retainer 28 apart, one is best able to open the mouth of the bag.

In the preferred embodiment of the present invention, the flexible tubular material 10 used for the body of the bag is a tubular plastic mesh. However it could be any flexible material including woven fabric, sheet plastic or leather which is in tube form or is fashioned into a tube via a seam or seams.

The semirigid drawstring 22 is preferably vinyl tubing. However it could be any semirigid material including plastic or rubber tubing, cord or rope; it could be cotton or paper cord or rope, metal cable, or a band of plastic, metal or stiff fabric.

The drawstring retainer 28 is a spherical bead, which can be made to resemble the earth. However, it could be any material, plastic, metal, wood or rubber. And it could be any shape including cylindrical, or rectilinear. Also it could be a flat ring like a washer.

The hollow handle 24 is acrylic or polycarbonate tubing. However it could be any material tubing, rigid plastic, hard rubber or vinyl, metal, wood, or bamboo. It could be molded to any shape deemed to be advantageous for a particular use. It also can be printed upon or contain other identifying features such as embossing, engraving, or raised letters or designs.

The shoulder strap 26 is tubular plastic mesh of a lighter weight and smaller opening size than the tubular mesh 10 used in the body of the bag. However it could be a rope, a strap of any material, leather, cotton, plastic or possibly metal for some applications. Within the handle 24, the shoulder strap 26 is fastened by a knot 32, i.e. the ends of the shoulder strap 26 are tied together to create a closed loop. However, the knot or fastener 32 can be outside the handle 24. And it could be a fastener of any kind. It could be a hook-and-loop fastener, a buckle, a snap, a bow, a hook and eye, a cinch, a magnet or magnets, a pin, or a seam, either sewn, glued, welded, or heat sealed.

The bottom seam 12 is created by lacing a length of cord 14 through openings in the tubular material 10 and inverted so that the material ends 15 are in the bag cavity 18. However it could remain exposed on the outside of the bag. And it could be created by sewing, gluing, or heat sealing the layers together. The cord 14 is vinyl tubing. However it could be any material, thread or glue. Or it could be cord or rope of any kind: plastic, rubber, leather, cotton, or paper. It could also be any rigid rod or band of plastic, metal, wood or any rigid material.

The ends 16 of the cord 14 in the bottom seam 12 as well as the drawstring ends 30 are knotted. However they could be flanged in any way. For example, a material could be inserted into the tubing or applied to the tubing and glued, pinned or sealed in place.

The optional "floating tag" 34 is a printed disk of acrylic or polycarbonate. However it could be any flat form of any rigid material: plastic, wood, metal or glass. Or it could be a flexible material: cotton fabric, plastic, rubber or vinyl. It could be a three-dimensional object such as a sphere or cube. Or it could be a combination of objects and materials trapped between the layers of flexible tubular material 10 to achieve an effect or alter the appearance of the bag.

Other modifications may be made without departing from the scope or spirit of the invention.

I claim:

1. A bag comprising:

(a) an enclosure formed of a tube of fabric, inverted on itself to form a double-walled enclosure, so that (1) ends of the tube are substantially aligned to form a bottom for the enclosure; and (2) the fabric inversion forms a mouth for the enclosure;

(b) a seam which closes the bottom of the enclosure;

(c) a handle which extends through a portion of the inversion in the enclosure to form a portion of the mouth;

(d) a semi-rigid drawstring which extends through the inversion in the enclosure to surround the mouth and assist in keeping the mouth open when desired; and (e) a retainer for capturing the drawstring to hold the bag mouth closed when desired.

2. A bag according to claim 1 in which the fabric is formed of plastic mesh.

3. A bag according to claim 2 in which the seam is formed of tubing placed through the plastic mesh so that the tube ends extend into the enclosure.

4. A bag according to claim 1 in which the drawstring is laced through the handle.

5. A bag according to claim 1 in which the retainer is a bead.

6. A bag according to claim 1 further including a shoulder strap formed of a loop of material laced through the handle.

7. A bag according to claim 1 further comprising an identifying tag interposed between the enclosure walls.

8. A bag according to claim 1 further comprising printing on the handle.

9. A bag according to claim 1 in which the drawstring is formed of plastic tubing.

10. A bag according to claim 1 in which the handle is formed of plastic tubing.

11. A bag comprising:

(a) an enclosure formed of a tube of plastic mesh, inverted on itself to form a double-walled structure so that (1) ends of the tube are substantially aligned to form a bottom for the enclosure; and (2) the mesh inversion forms a mouth for the enclosure;

(b) a seam which closes the bottom of the enclosure;

(c) a plastic tubing handle which extends through a portion of the inversion in the enclosure to form a portion of the mouth;

(d) a semi-rigid drawstring of plastic tubing which extends through the inversion in the enclosure to surround the mouth and assist in keeping the mouth open when desired; and (e) a retainer for capturing the drawstring to hold the bag mouth closed when desired.

12. A bag according to claim 11 in which the seam is formed of plastic tubing laced through the plastic mesh so that the tube ends extend into the enclosure.

13. A bag according to claim 11 in which the drawstring is laced through the handle.

14. A bag according to claim 11 in which the retainer is a bead.

15. A bag according to claim 11 further including a shoulder strap formed of a loop of material laced through the handle.

16. A bag according to claim 11 further comprising an identifying tag interposed between the enclosure walls.

17. A bag according to claim 11 further comprising printing on the handle.

18. A bag according to claim 11 in which the handle is formed of straight plastic tubing.

19. A bag according to claim 11 in which the handle is formed of curved plastic tubing.

20. A bag comprising:

(a) an enclosure formed of a tube of plastic mesh, inverted on itself to form a double-walled enclosure, so that (1) ends of the tube are substantially aligned to form a bottom for the enclosure; and (2) the mesh inversion forms a mouth for the enclosure;

(b) a seam formed of tubing laced through the plastic mesh so that the tube ends extend into the enclosure to form the bottom of the bag;

(c) a handle formed of plastic tubing which extends through a portion of the inversion in the enclosure to form a part of the mouth;

(d) a plastic tubing semi-rigid drawstring which extends through the handle and through the inversion in the enclosure to surround the mouth and assist in keeping the mouth open when desired;

(e) a bead which captures both ends of the drawstring to hold the bag mouth closed when desired; and (f) a tag interposed between the enclosure walls.

* * * * *